US005186024A

United States Patent [19]

Waters, Jr.

[11] Patent Number: 5,186,024

[45] Date of Patent: Feb. 16, 1993

[54] HIGH BRILLIANCE STEP-CUT STONE AND METHOD OF MAKING SAME

[75] Inventor: Lester C. Waters, Jr., Carrollton, Tex.

[73] Assignee: Dorothy P. Waters, Carrollton, Tex.

[21] Appl. No.: 892,975

[22] Filed: Feb. 3, 1992

[51] Int. Cl.[5] ..... A44C 17/00

[52] U.S. Cl. ..... 63/32

[58] Field of Search ..... 63/32; 125/30.01; 51/283 R

[56] References Cited

U.S. PATENT DOCUMENTS

| | | | |
|---|---|---|---|
| 138,314 | 4/1873 | Bruhl | 63/32 |
| 2,009,390 | 7/1935 | Bayard | 63/32 |
| 3,490,250 | 1/1970 | Jones | 63/32 |
| 3,796,065 | 3/1974 | Watermeyer | 63/32 |
| 4,020,649 | 5/1977 | Grossbard | 63/32 |
| 4,555,916 | 12/1985 | Grossbard | 63/32 |

FOREIGN PATENT DOCUMENTS

| | | | |
|---|---|---|---|
| 324092 | 8/1902 | France | 63/32 |

*Primary Examiner*—Renee S. Luebke

*Assistant Examiner*—Flemming Saether

*Attorney, Agent, or Firm*—W. Kirk McCord

[57] ABSTRACT

A high brilliance step-cut gem stone is formed by cutting natural or man-made gem stone material at a cutting angle of 90° along respective cutting machine indices of 96, 48, 72 and 24 to form a rectangular block and then shaping the rectangular block by cutting the block along respective indices 94, 2, 50, 46, 70, 74, 26 and 22, to define an octagonal prism. The pavilion portion of the stone is formed by cutting a plurality of pavilion facets in stepped increments along each of the indices 94, 2, 50, 46, 70, 74, 26 and 22. A first group of pavilion facets defining the culet is cut at the critical angle of the material and each successive group of facets is cut in successive stepped increments of 6° relative the critical angle, up to the girdle. A plurality of crown facets are also cut in stepped increments along each of the indices 94, 2, 50, 46, 70, 74, 26 and 22, upwardly from the girdle to define a relatively flat table at the top of the stone. In accordance with the present invention, an octagonal step-cut gem stone is provided having a higher brilliance and a wider cone of brilliance than the conventional rectangular or square step cut gem stone.

6 Claims, 2 Drawing Sheets

HIGH BRILLIANCE STEP-CUT STONE AND METHOD OF MAKING SAME

FIELD OF INVENTION

This invention relates generally to gem stones and the like and in particular to a high brilliance step-cut gem stone and method of making same.

BACKGROUND OF THE INVENTION

Precious stones, such as diamond, topaz, corrundum, beryl and quartz etc., are often used in jewelry, such as rings and necklaces, because of their high brilliance and/or color. Gem stone material may be cut to a desired size and shape. The shape of the stone affects the light reflection characteristics thereof.

DESCRIPTION OF THE PRIOR ART

According to prior practice, gem stones are shaped using a facet cutting machine. The machine cuts the stone to form a plurality of "facets" (i.e., flat faces) oriented at respective angles relative to a predetermined critical angle of the stone. In the so-called "step-cut" procedure, the facets are cut at respective predetermined angles relative to the critical angle of the stone. The "step-cut" procedure is typically used in connection with rectangular or square-shaped stones.

Rectangular or square-shaped stones typically do not exhibit a high degree of brilliance. Furthermore, the typical rectangular or square-cut stone does not have a wide cone of brilliance.

DISCLOSURE OF THE INVENTION

In accordance with the present invention, a step-cut gem stone is provided having a pavilion portion, a crown portion and a girdle intermediate the pavilion and crown portions. The pavilion portion is defined by a plurality of groups of pavilion facets, each group having eight discrete facets cut at the same predetermined angle relative to a critical angle of the pavilion portion. Each group of pavilion facets defines a predetermined step increment between a culet defining a bottom part of the stone and the girdle. The crown portion is defined by a plurality of groups of crown facets, each group having eight discrete facets cut at the same predetermined angle relative to a critical angle of the crown portion. The groups of crown facets are cut at respective predetermined stepped increments between the girdle and a relatively flat table defining a top part of the stone. In accordance with a unique feature of the invention, the stone has a substantially octagonal lateral cross- section, such that both the pavilion portion and the crown portion have eight distinct sides, as opposed to four sides in the conventional rectangular or square-cut stone.

The gem stone is preferably formed by cutting a natural or man-made gem stone material at a cutting angle of approximately 90°, sequentially at cutting machine indices 96, 48, 72 and 24, to shape the stone into a cubical block. The cubical block is then further shaped by cutting the block at respective machine indices 94, 2, 50, 46, 70, 74, 26 and 22 to form an octagonal prism having substantially octagonal opposed top and bottom surfaces and eight distinct sides extending between the octagonal top and bottom surfaces. The octagonal prism is then cut to form the pavilion and crown portions of the stone, with the girdle intermediate the pavilion and crown portions.

In accordance with another unique feature of the invention, a first group of pavilion facets is cut at the critical angle of the pavilion portion, thereby forming the culet. The next successive group of pavilion facets is cut at an angle 6° greater than the critical angle and the next successive group of pavilion facets is cut at an angle of 12° greater than the critical angle and so on, such that the groups of pavilion facets are cut at successive 6° angular steps from the culet to the girdle. For example, if the pavilion portion includes four groups of pavilion facets, four groups are cut in sequence from the culet to the girdle at respective discrete angles equal to the critical angle, 6° greater than the critical angle, 12° greater than the critical angle and 18° greater than the critical angle.

A first group of crown facets adjacent the girdle is also cut at an angle 6° greater than the critical angle of the crown portion. In one embodiment, the crown portion has three discrete groups of crown facets. A first group of crown facets, which is adjacent the girdle, is cut at an angle 6° greater than the critical angle of the crown portion, a second group of crown facets is cut at an angle corresponding to the critical angle of the crown portion and a third group of crown facets, which is adjacent the table, is cut at an angle 15° less than the critical angle of the crown portion.

In accordance with the present invention, a high brilliance step-cut stone is provided having a significantly higher degree of brilliance and a wider cone of brilliance than a conventional rectangular or square-cut stone. The octagonal shape of the stone defines a plurality of inwardly converging facet surfaces, which direct light toward the interior of the stone, thereby significantly enhancing the brilliance thereof. The 6° angular increments between successive step cuts has also been found to enhance the brilliance of the stone.

DETAILED DESCRIPTION OF THE PREFERRED EMBODIMENT

Figure 1:
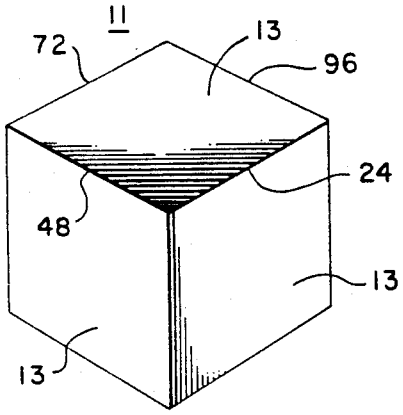
FIGS. 1–3 are various views illustrating a method of making a high brilliance step-cut gem stone, according to the present invention.

In the description which follows, like parts are marked throughout the specification and drawings with the same respective reference numerals. The drawings are not necessarily to scale and in some instances proportions may have been exaggerated in order to more clearly depict certain features of the invention.

Referring to FIGS. 1–4, a high brilliance step-cut gem stone is formed from a natural or man-made gem stone material using a conventional facet cutting machine. The cutting element of the machine is initially set at a 90° cutting angle relative to the machine lap and the stone is cut sequentially at machine indices 96, 48, 72 and 24 to shape the stone into a cubical block 11, with six substantially square faces 13, as depicted in FIG. 1. Although a cubical block 11 is depicted, one skilled in the art will recognize that block 11 may be generally rectangular instead of cubical.

Figure 2:
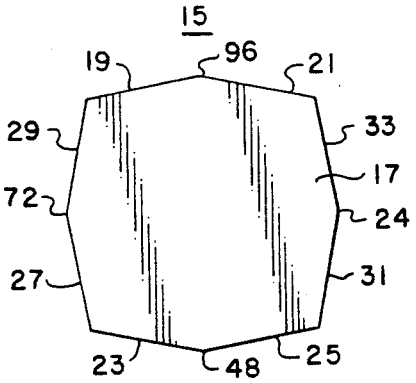

In accordance with the present invention, block 11 is shaped to form a substantially octagonal prism 15, as depicted in FIG. 2. Prism 15 is a polyhedron with opposed top and bottom octagonal faces 17 lying in parallel planes. The side faces connecting the top and bottom octagonal faces 17 are parallelograms. The top octagonal face 17 is shown in FIG. 2. Prism 15 is formed by cutting block 11 from index point 96 along indices 94 and 2 to define respective faces 19 and 21, from index point 48 along indices 50 and 42 to define respective faces 23 and 25, from index point 72 along indices 70 and 74 to define respective legs 27 and 29, and from index point 24 along indices 26 and 22 to define respective faces 31 and 33. Each of the faces 19, 21, 23, 25, 27, 29, 31 and 33 have substantially the same shape and dimensions.

Figure 3:
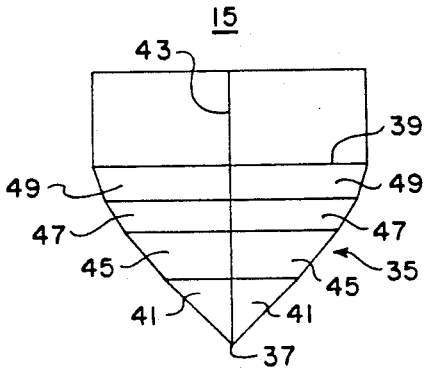

As depicted in FIG. 3, octagonal prism 15 is shaped further to define a pavilion portion (i.e., bottom portion) of the stone, indicated generally at 35, by step cutting a plurality of facets oriented at respective discrete angles with respect to the critical angle of the pavilion portion, to define a culet 37 at the nadir of the stone and a girdle 39 which defines the boundary between pavilion portion 35 and a crown portion (i.e., top portion) of the stone, indicated generally at 51. A first group of pavilion facets 41 is cut to define culet 37. The cutting angle is initially set at the critical angle of the stone material. For example, if the material is quartz, the critical angle is 41°. Eight facets 41 are cut at the critical angle, sequentially along the respective cutting machine indices 94, 2, 50, 46, 70, 74, 26 and 22, thereby forming culet 37. Each facet 41 is oriented such that an axis perpendicular to the plane of each facet 41 is coincidental with the critical angle (e.g., 41°).

A second group of pavilion facets 45 is formed by setting the cutting angle at an angle 6° greater than the critical angle. For example, in the case of quartz material, facets 45 are cut at a cutting angle of 47°. Eight facets 45 are cut sequentially along the respective indices 94, 2, 50, 46, 70, 74, 26 and 22.

A third group of pavilion facets 47 is formed by setting the cutting angle at an angle 12° greater than the critical angle. For example, in the case of quartz material, the cutting angle for the third group of pavilion facets 47 is 53°. Eight facets 47 are cut sequentially along respective indices 94, 2, 50, 46, 70, 74, 26 and 22.

A fourth group of pavilion facets 49 is formed by setting the cutting angle at an angle 18° greater than the critical angle. In the case of quartz, the cutting angle for the fourth group of facets 49 is 59°. Eight facets 49 are cut sequentially along respective indices 94, 2, 50, 46, 70, 74, 26 and 22. Each facet 49 terminates at girdle 39. Girdle 39 is defined by a relatively narrow vertical face extending around the perimeter of the stone at the widest portion of the stone.

In the example described above, pavilion portion 35 includes four discrete groups of facets 41, 45, 47 and 49, which are oriented at respective discrete angles, to define a "step-cut" bottom portion of the stone. The individual facets of each discrete group of pavilion facets have substantially the same shape and dimensions. Each group of facets 41, 45, 47, 49 is comprised of eight distinct facets, which are cut along the respective machine indices 94, 2, 50, 46, 70, 74, 26 and 22.

Figure 4:
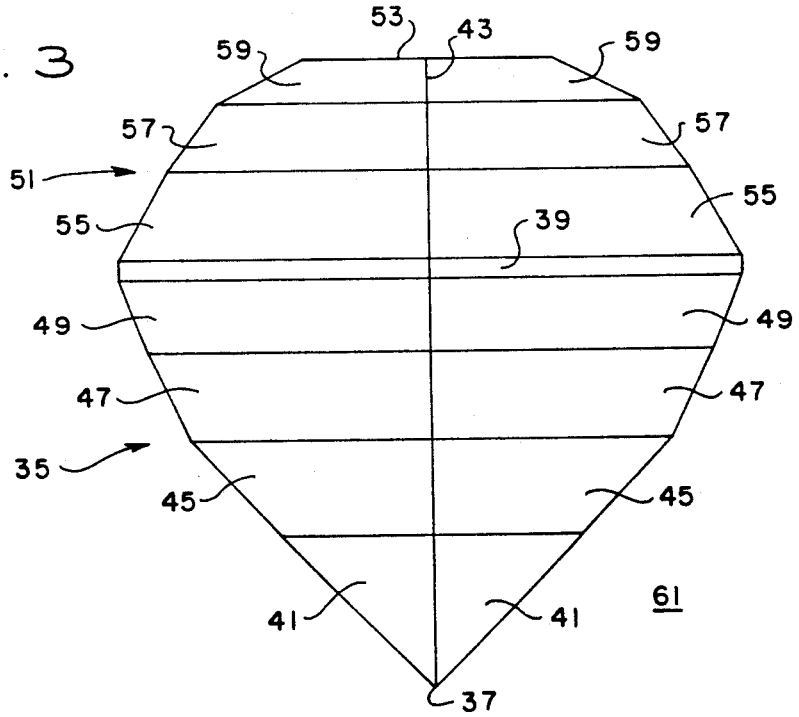
FIG. 4 is an elevational view of a high brilliance step-cut gem stone, according to the present invention.

After pavilion portion 35 has been formed, a crown portion, indicated generally at 51, is formed, as illustrated in FIG. 4. Crown portion 51 extends upwardly from girdle 39 and terminates at a relatively flat table 53, which defines the top surface of the stone.

As depicted in FIG. 4, crown portion 51 is formed by step cutting three discrete groups of facets 55, 57 and 59 in sequence, upwardly from girdle 39 to table 53. A first group of crown facets 55 is formed by setting the machine cutting angle at an angle 6° greater than the critical angle of crown portion 51. The critical angle of crown portion 51 may be different from the critical angle of pavilion portion 35. For example, when quartz material is used, the critical angle of crown portion 51 is 45°, whereas the critical angle of the pavilion portion 35 is 41°, as previously described. In the case of quartz material, the first group of crown facets 55 is formed by cutting the stone at a cutting angle of 51°. Eight facets 55 are cut sequentially along respective cutting machine indices 94, 2, 50, 46, 70, 74, 26 and 22.

A second group of crown facets 57 is formed by setting the cutting angle at the critical angle of crown portion 51 (e.g., 45° in the case of quartz). Eight facets are 57 are cut sequentially along the respective indices 94, 2, 50, 46, 70, 74, 26 and 22 at the critical angle of 45°.

A third group of crown facets 59 is formed by setting the cutting angle at an angle 15° less than the critical angle of crown portion 51. In the case of quartz, the cutting angle for the third group of facets 59 is 30°. Eight facets 59 are cut sequentially along respective indices 94, 2, 30, 46, 70, 74, 26 and 22. Each facet 59 terminates at table 53.

Crown portion 51 therefore includes three discrete groups of facets 55, 57 and 59, which are oriented at respective discrete angles, to define a "step-cut" top portion of a gem stone. The individual facets of each group of crown facets have substantially the same shape and dimensions. Each group of facets 55, 57 and 59 is comprised of eight distinct facets, which are cut along the respective machine indices 94, 2, 50, 46, 70, 74, 26 and 22.

The results of the shaping procedure described above with respect to FIGS. 1–4 is a unique step-cut gem stone, indicated generally at 61 in FIG. 4. Stone 61 has a more brilliant appearance and a wider cone of brilliance than conventional step-cut gem stones. The surfaces of stone 61 are highly polished to enhance the brilliance thereof, according to conventional polishing procedures. The distance along a central axis 43 from culet 37 to girdle 39 is approximately two times the distance along central axis 43 from girdle 39 t table 53. The distance between culet 37 and table 53 is approximately $\frac{3}{4}$ of the width of stone 61 at its widest portion (i.e., at girdle 39).

Figure 5:
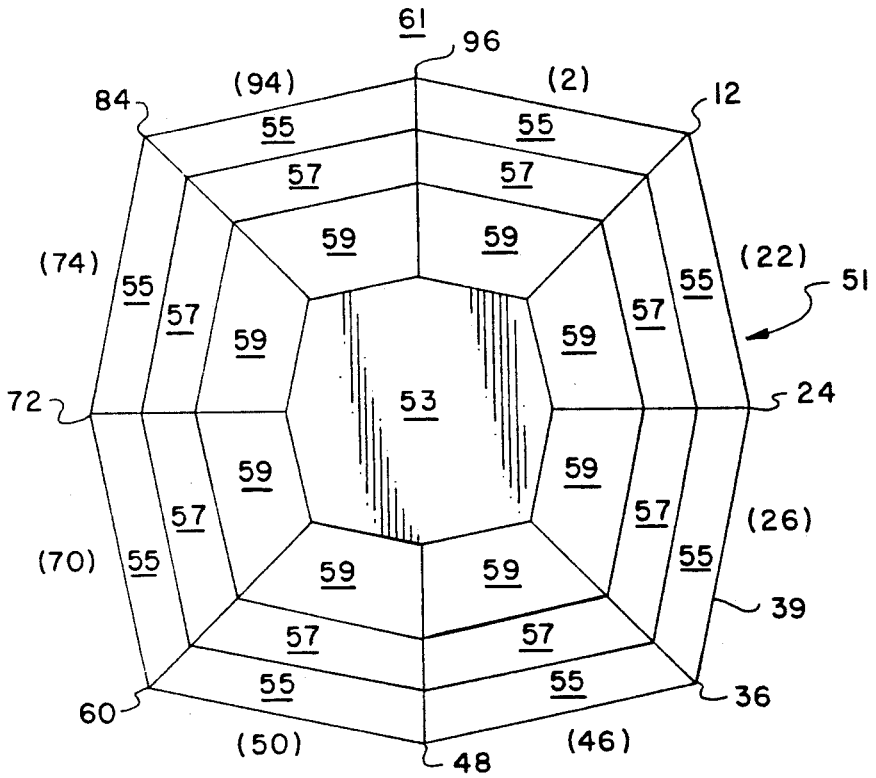
FIG. 5 is a top plan view of the gem stone of FIG. 4.
Figure 6:
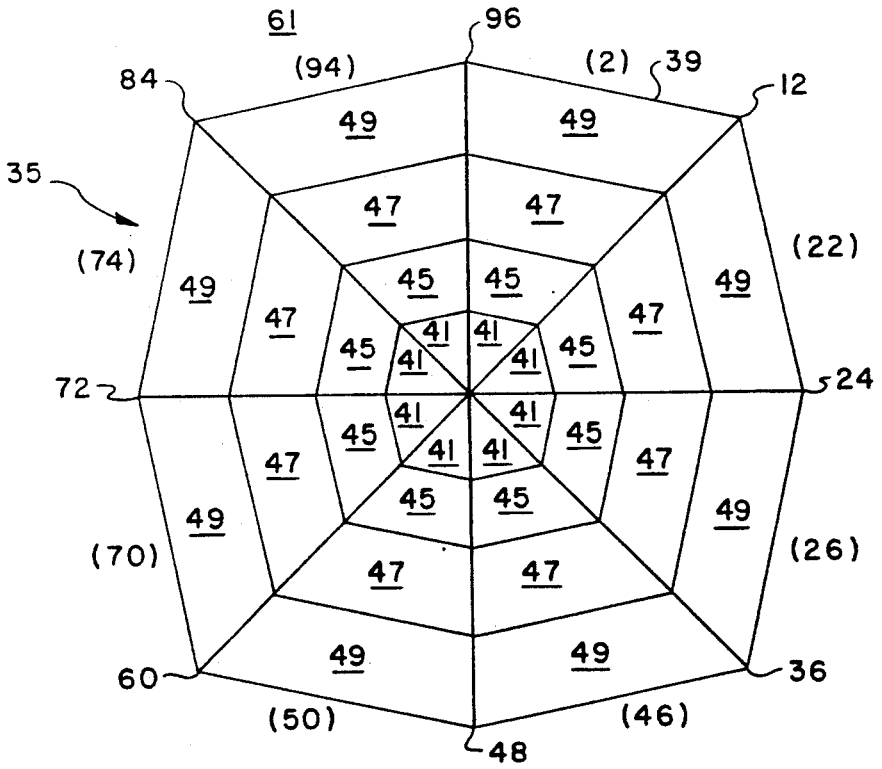
FIG. 6 is a bottom plan view of the gem stone of FIG. 4.

Referring also to FIGS. 5 and 6, respective plan views of crown portion 51 and pavilion portion 35 are shown. The various cutting machine indices corresponding to the eight octagonal points of the finished stone 61 are shown in FIGS. 5 and 6. The respective cutting machine indices corresponding to the eight sides defining the octagonal shape of stone 61 are indicated in parentheses. FIGS. 4, 5, and 6 clearly illustrate the "step cut" configuration of stone 61.

One skilled in the art will recognize that the number of discrete groups of facets on both pavilion portion 35 and crown portion 51 is a matter of design choice. Furthermore, the method of forming a high brilliance gem stone, as described above with reference to FIGS. 1–6 can be used with any type of gem stone and is not limited to the quartz material used as the example herein.

The critical angle may vary according to the particular type of stone, but it has been determined by extensive experimentation that it is advantageous to cut the various step facets of the pavilion portion of the stone in stepped increments of 6° relative to the critical angle (i.e., 6°, 12°, 18°, etc), irrespective of the particular type of gem stone being cut. Although the shaping method according to the present invention has been described with reference to converting a "square step cut" stone to an octagonal step cut stone, the method is also generally applicable to "rectangular cut" stone to an octagonal step cut stone.

In accordance with the present invention, a conventional rectangular or square step cut stone is modified by tapering the four sides of the rectangular or square step cut stone to define an octagonal step cut stone. The stone has an octagonal-shaped lateral cross-section, taken at any position on the stone. The octagonal shape of the stone defines a plurality of inwardly converging facet surfaces, which direct light toward the interior of the stone, to significantly enhance the brilliance and beauty of the finished gem stone.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

What is claimed is:

1. A cut stone having a pavilion portion, a crown portion and a girdle intermediate said pavilion portion and said crown portion, said stone having a substantially octagonal lateral cross-section, said pavilion portion being defined by a plurality of discrete groups of pavilion facets, each discrete group of pavilion facets having eight discrete pavilion facets cut at respective predetermined cutting machine indices, all of the pavilion facets of the same discrete group being cut at the same discrete cutting angle, adjacent ones of the pavilion facets of the same discrete group having substantially the same shape and dimensions, said crown portion being defined by a plurality of discrete groups of crown facets, each discrete group of crown facets having eight discrete crown facets cut at respective predetermined machine cutting indices, all of the crown facets of the same discrete group being cut at the same discrete cutting angle, adjacent ones of the crown facets of the same discrete group having substantially the same shape and dimensions.

2. The stone of claim 1 wherein all of the pavilion facets of the same discrete group have substantially the same shape and dimensions and all of the crown facets of the same discrete group have substantially the same shape and dimensions.

3. The stone of claim 2 wherein a first discrete group of crown facets adjacent said girdle is cut at a cutting angle approximately 6° greater than a critical angle of said crown portion, a second discrete group of crown facets being cut at a cutting angle corresponding to the critical angle of said crown portion and a third discrete group of crown facets adjacent said table being cut at a cutting angle approximately 15° less than the critical angle of said crown portion.

4. The stone of claim 1 wherein a first discrete group of pavilion facets is cut at an angle corresponding to a critical angle of said pavilion portion to define said culet, succeeding discrete groups of pavilion facets in sequence from said first group to said girdle being cut at respective discrete cutting angles corresponding to successive approximately 6° stepped increments relative to the critical angle of said pavilion portion.

5. The stone of claim 3 wherein said crown portion is defined by a plurality of discrete groups of crown facets, each discrete group of crown facets having eight discrete crown facets cut at respective predetermined cutting machine indices, all of the crown facets of the same discrete group being cut at the same discrete cutting angle, a first group of crown facets adjacent said girdle being cut at a cutting angle approximately 6° greater than a critical angle of said crown portion, a second discrete group of crown facets being cut at a cutting angle corresponding to the critical angle of said crown portion and a third discrete group of crown facets adjacent said table being cut at a cutting angle approximately 15° less than the critical angle of said crown portion.

6. A cut stone having a pavilion portion, a crown portion and a girdle intermediate said pavilion portion and said crown portion, said pavilion portion being defined by a plurality of discrete groups of pavilion facets, each discrete group of pavilion facets having eight discrete pavilion facets cut at respective predetermined cutting machine indices, all of the pavilion facets of the same discrete group being cut at the same discrete cutting angle, a first discrete group of pavilion facets being cut at an angle corresponding to a critical angle of said pavilion portion to define said culet, succeeding discrete groups of pavilion facets in sequence from said first discrete group to said girdle being cut at respective discrete cutting angles corresponding to successive approximately 6° stepped increments relative to the critical angle of said pavilion portion.

* * * * *